US011012800B2

(12) United States Patent
Tu et al.

(10) Patent No.: US 11,012,800 B2
(45) Date of Patent: May 18, 2021

(54) CORRECTION SYSTEM AND CORRECTION METHOD OF SIGNAL MEASUREMENT

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/740,502

(22) Filed: Jan. 13, 2020

(65) Prior Publication Data

US 2021/0084428 A1 Mar. 18, 2021

(30) Foreign Application Priority Data

Sep. 16, 2019 (TW) ..... 108133148

(51) Int. Cl.
*H04S 7/00* (2006.01)
*H04R 29/00* (2006.01)

(52) U.S. Cl.
CPC ..... *H04S 7/301* (2013.01); *H04R 29/00* (2013.01); *H04S 7/305* (2013.01); *H04S 7/307* (2013.01)

(58) Field of Classification Search
None
See application file for complete search history.

(56) References Cited

U.S. PATENT DOCUMENTS 6,608,904 B1 * 8/2003 Feltstrom ..... G10K 11/178 381/59
6,760,451 B1 * 7/2004 Craven ..... H03G 5/005 381/59
7,117,145 B1 10/2006 Venkatesh et al.
8,976,972 B2 * 3/2015 Emerit ..... H04S 1/002 381/23
9,691,407 B2 * 6/2017 Oda ..... G10L 21/0216
9,916,840 B1 * 3/2018 Do ..... H04M 9/082
2002/0023020 A1 * 2/2002 Kenyon ..... G10L 25/48 704/231
2003/0223591 A1 * 12/2003 Murase ..... H04S 1/002 381/92
2005/0135631 A1 * 6/2005 Yoshino ..... H04S 7/301 381/59
2009/0060224 A1 * 3/2009 Hayakawa ..... H04R 3/005 381/97
2011/0033063 A1 * 2/2011 McGrath ..... H04S 7/30 381/92

(Continued)

*Primary Examiner* — Qin Zhu
(74) *Attorney, Agent, or Firm* — JCIPRNET

(57) ABSTRACT

A correction system and a correction method of signal measurement are provided. In the method, a transmitted signal and a received signal are divided into a plurality of transmitted signal groups and a plurality of received signal groups according to a time length, respectively. The received signal is related to a signal received after the transmitted signal is transmitted, and the transmitted signal is a periodic signal. A plurality of to-be-evaluated groups are selected from the received signal groups according to a correlation between the transmitted signal groups and the received signal groups. The correlation corresponds to a delay between the transmitted signal and the received signal. The signal energy of the received signal is determined according to the signal energy of the to-be-evaluated groups. Accordingly, the accuracy of signal measurement can be improved.

14 Claims, 5 Drawing Sheets

(56) References Cited

U.S. PATENT DOCUMENTS

| | | | | |
|---|---|---|---|---|
| 2015/0078596 | A1* | 3/2015 | Sprogis | H04S 7/301 381/303 |
| 2015/0215721 | A1* | 7/2015 | Sato | H04S 7/307 381/307 |
| 2015/0271616 | A1* | 9/2015 | Kechichian | H04R 29/004 381/58 |
| 2015/0277847 | A1* | 10/2015 | Yliaho | G06F 3/16 381/122 |
| 2017/0195789 | A1* | 7/2017 | Higure | H04H 20/61 |

* cited by examiner

CORRECTION SYSTEM AND CORRECTION METHOD OF SIGNAL MEASUREMENT

CROSS-REFERENCE TO RELATED APPLICATION

This application claims the priority benefit of Taiwan application serial no. 108133148, filed on Sep. 16, 2019. The entirety of the above-mentioned patent application is hereby incorporated by reference herein and made a part of this specification.

BACKGROUND OF THE INVENTION

1. Field of the Invention

The invention generally relates to a signal processing method, and in particular, to a correction system and a correction method of signal measurement.

2. Description of Related Art

In order to achieve a dual-track balance effect, in the prior art, a dual-track energy state is measured for a sinusoidal wave of a center frequency of each band, and then a target gain suitable for each frequency is defined according to characteristics of a sound field. Equalizations (EQs) of dual tracks are respectively adjusted to approximate to the target gain, thereby achieving the dual-track balance effect.

However, an environment where a user stands is not a quiet anechoic chamber, and external sounds may possibly interfere with a measurement result of a played signal. These interferences may distort the measurement result, and a distortion situation may further affect the dual-track balance effect.

SUMMARY OF THE INVENTION

Accordingly, embodiments of the invention provide a correction system and a correction method of signal measurement, so as to correct a received signal based on a signal characteristic of a transmitted signal, thereby improving accuracy of measurement.

The correction method of signal measurement of the embodiments of the invention includes, but is not limited to, the following steps. A transmitted signal and a received signal are divided into a plurality of transmitted signal groups and a plurality of received signal groups according to a time length, respectively. The received signal is related to a signal received after the transmitted signal is transmitted, and the transmitted signal is a periodic signal. A plurality of to-be-evaluated groups are selected from the received signal groups according to a correlation between the transmitted signal groups and the received signal groups. The correlation corresponds to a delay between the transmitted signal and the received signal. Signal energy of the received signal is determined according to signal energy of the to-be-evaluated groups.

The correction system of signal measurement of the embodiments of the invention includes, but is not limited to, a processing device. The processing device is loaded with and executes a plurality of modules, and the modules include a signal division module, a screening module and an energy determining module. The division module divides a transmitted signal and a received signal into a plurality of transmitted signal groups and a plurality of received signal groups according to a time length, respectively, wherein the received signal is related to a signal received after the transmitted signal is transmitted, and the transmitted signal is a periodic signal. The screening module selects a plurality of to-be-evaluated groups from the received signal groups according to a correlation between the transmitted signal groups and the received signal groups, wherein the correlation corresponds to a delay between the transmitted signal and the received signal. The energy determining module determines signal energy of the received signal according to signal energy of the to-be-evaluated groups.

Based on the above, the correction system and the correction method of signal measurement of the embodiments of the invention divide the transmitted and received signals, and screen out the classified received signal groups with a larger quantity according to a delay situation and a energy state between the transmitted signal groups and the received signal groups which are obtained after division, and then energy of the received signal groups may be used as a representative of signal energy of the received signal. In addition, the embodiments of the invention maintain a periodic change characteristic of the transmitted signal for the received signal to eliminate interferences. Therefore, the accuracy of measurement can be improved, and a user can correct dual-track balance anywhere without environmental limitation.

In order to make the aforementioned and other objectives and advantages of the invention comprehensible, embodiments accompanied with figures are described in detail below.

DESCRIPTION OF THE EMBODIMENTS

Figure 1:
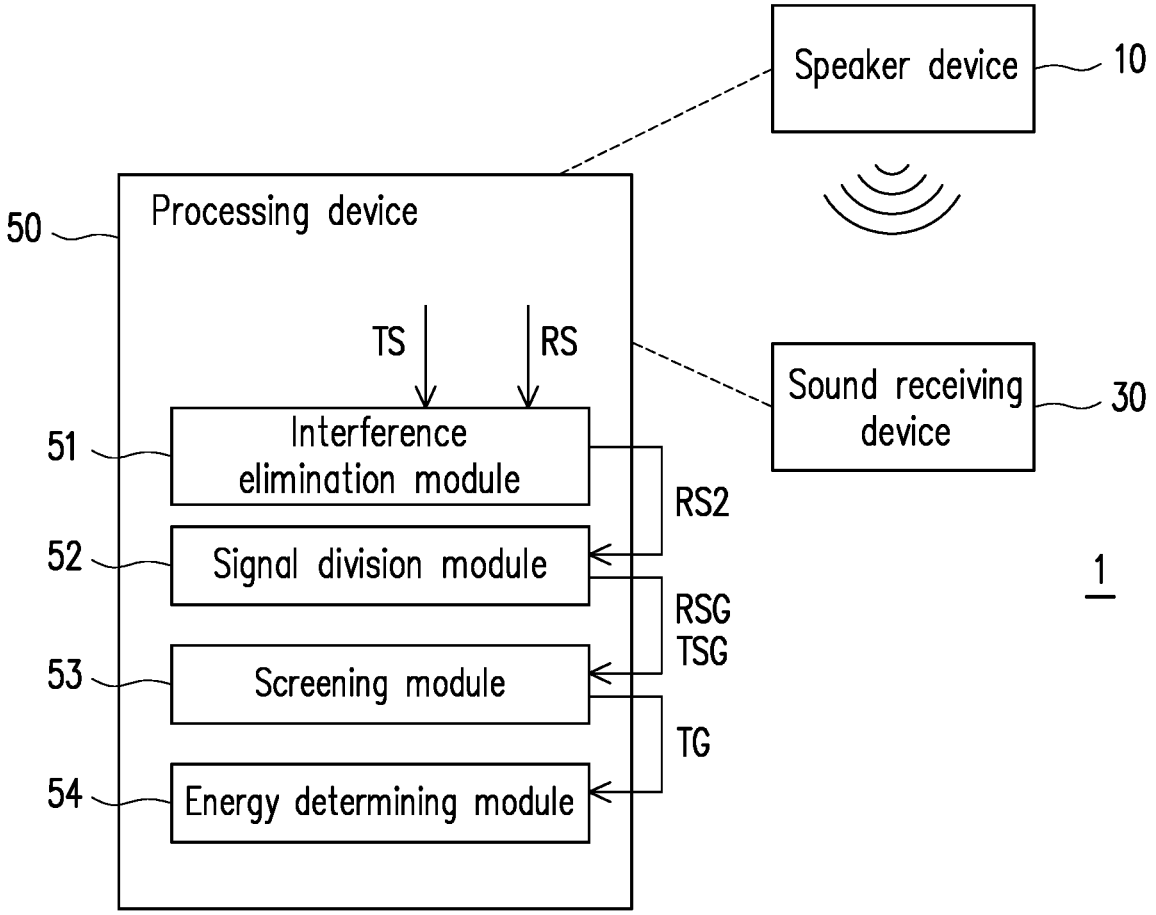
FIG. 1 is a schematic diagram of a correction system of signal measurement according to one embodiment of the invention.

FIG. 1 is a schematic diagram of a correction system 1 of signal measurement according to one embodiment of the invention. Referring to FIG. 1, the correction system 1 includes, but is not limited to, a speaker device 10, a sound receiving device 30 and a processing device 50.

The speaker device 10 may be a device configured to play sounds, such as a horn (speaker) and a megaphone.

The sound receiving device 30 may be a microphone (such as a dynamic type, a condenser type and an electret condenser type) or other electronic devices capable of receiving sound waves and converting them into sound signals.

The processing device 50 may be a desktop computer, a notebook computer, a smart phone, a tablet computer or a server. The processing device 50 at least includes a processor (such as a central processing unit (CPU), or other programmable general-purpose or special-purpose microprocessor, a digital signal processor (DSP), a field programmable gate array (FPGA), a programmable controller, an application-specific integrated circuit (ASIC) or other similar elements or a combination of the above elements), so as to perform all operations of the processing device 50. In the embodiment of the invention, the processing device 50 may be loaded with and execute software modules (stored in a memory), and the software modules include an interference elimination module 51, a signal division module 52, a screening module 53 and an energy determining module 54. Detailed operations of the software modules are described in detail in the following embodiments.

It should be noted that the processing device 50 may be electrically connected to the speaker device 10 and the sound receiving device 30. One or more of the devices 10, 30, 50 may also be integrated into a single electronic device. In some embodiments, the correction system 1 may also include only the processing device 50.

In order to facilitate understanding of an operation flow of the embodiment of the invention, a plurality of embodiments will be exemplified below to describe the operation flow of the correction system 1 in the embodiment of the invention in detail. Hereinafter, the method of the embodiment of the invention will be described in conjunction with various devices in the correction system 1. The various flows of the method may be adjusted according to implementation situations, and are not limited thereto.

Figure 2:
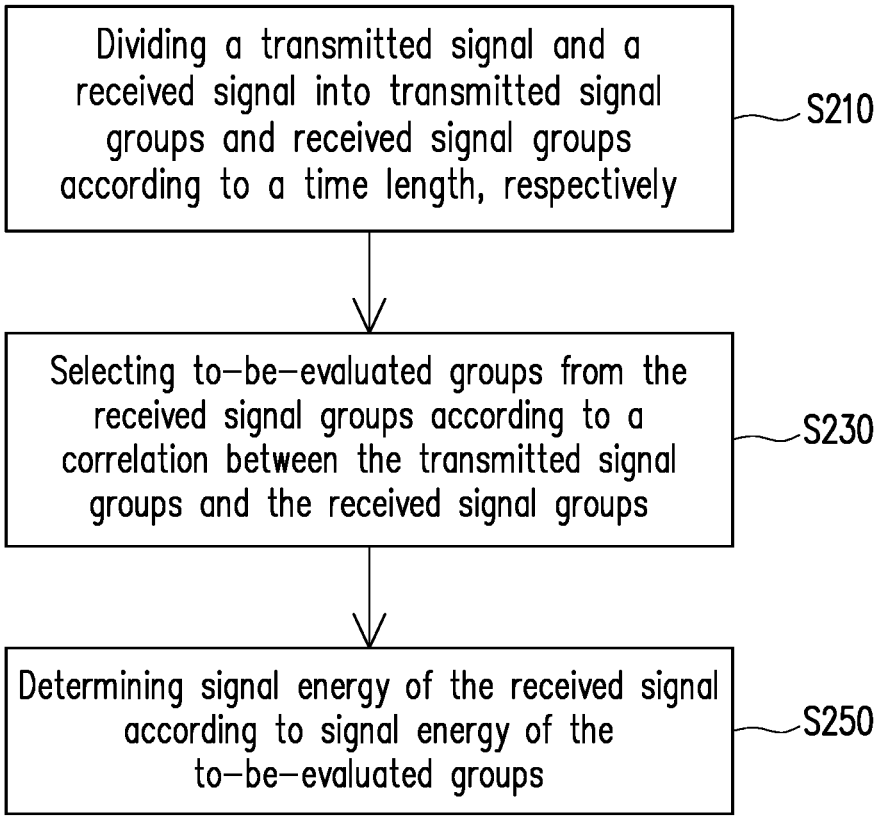
FIG. 2 is a flowchart of a correction method of signal measurement according to one embodiment of the invention.

FIG. 2 is a flowchart of a correction method of signal measurement according to one embodiment of the invention. Referring to FIG. 2, a signal division module 52 of the processing device 50 divides a transmitted signal TS and a received signal RS into a plurality of transmitted signal groups TSG and a plurality of received signal groups RSG according to a time length, respectively (Step S210). Specifically, the received signal RS is related to a signal received after the transmitted signal is transmitted. In one embodiment, a speaker device 10 may play the transmitted signal (i.e., a sound signal), and a sound receiving device 30 receives sounds in response to playing of the transmitted signal to obtain a sound received signal. The sound received signal may be used as the received signal. According to different requirements, the speaker device 10 may respectively play a plurality of transmitted signals having different center frequencies, and the center frequencies corresponding to the transmitted signals are respectively corresponding to different bands. Meanwhile, the sound receiving device 30 sequentially receives sounds from sound signals having different center frequencies to generate the sound received signal. In another embodiment, the signal division module 52 may also obtain the sound received signals in manners such as a downloading or data inputting manner. In addition, the signal division module 52 may sample the sound received signals according to a sampling point number (such as 24000 (about 0.5 seconds), or other numbers) at a specific length to form discrete received signals for subsequent signal processing.

It should be noted that in order to facilitate description, there is a hypothesis below that a received signal having a certain center frequency is processed.

In order to maintain a signal characteristic of the transmitted signal, in one embodiment, the interference elimination module 51 may eliminate interference in the sound received signal according to the signal characteristic of the transmitted signal to obtain the received signal. It is worth noting that the transmitted signal is a periodic signal (such as a sinusoidal signal, a periodic square wave signal, or a triangular wave signal), and the signal characteristic is related to a periodic change of the periodic signal. That is, amplitudes of the signals all periodically change, and the amplitudes corresponding to the same phase are the same in different periods. There is no fixed periodic waveform noise in life, and thus such a signal characteristic may be contributive to eliminating the interference in the signal received signal. The embodiments of the invention may restore the received signal till it has the same signal characteristic as the transmitted signal.

Figure 3A:
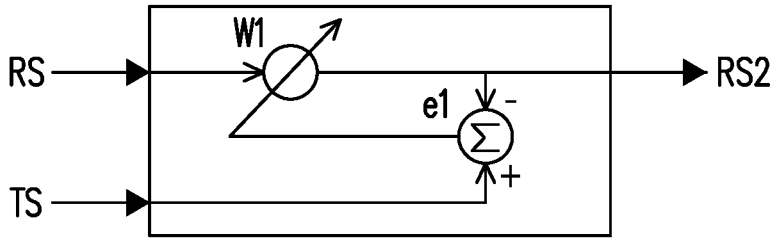
FIG. 3A and FIG. 3B are schematic diagrams of signal interference elimination according to one embodiment of the invention.
Figure 3B:
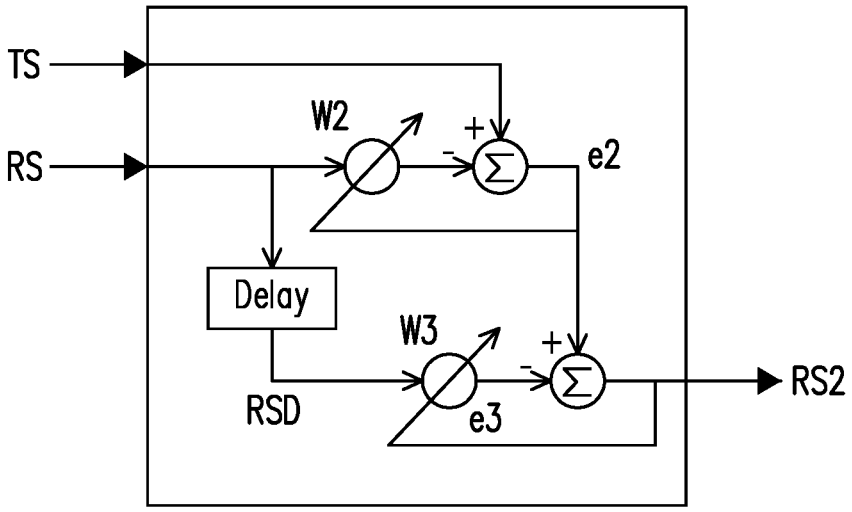

In one embodiment, the interference elimination module 51 maintains the periodic change characteristic in the received signal based on an adaptive signal processing technology. FIG. 3A and FIG. 3B are schematic diagrams of signal interference elimination according to one embodiment of the invention. Referring to FIG. 3A at first as one-stage adaptive signal processing, an error e1 between a product of the received signal RS and a weight W1 and the transmitted signal TS may be minimized, and an output signal RS is an intersection of the transmitted signal TS and the received signal RS. Assuming that the transmitted signal TS is a single-frequency sinusoidal signal, the output signal RS thereof is very close to a sinusoidal signal with this frequency (i.e., the output signal has the periodic change characteristic of a sinusoidal wave).

Referring to FIG. 3B at first as two-stage adaptive signal processing, an error e2 between the transmitted signal TS at a 0th stage and the received signal RS (multiplied by a weight W2) may be regarded as an environmental interference, and the error e2 may be used as a reference/target signal at a first stage. In addition, a delay signal RSD (multiplied by a weight W3) of the received signal RS may be used as an input signal at the first stage, and an error e3 of first-stage adaptive signal processing is an interference-eliminated sinusoidal wave characteristic output signal RS2.

Since the periodic change of the transmitted signal is known, the interference elimination module 51 may restore the received signal RS to be closer or equivalent to the transmitted signal TS, thereby eliminating the interference. It should be noted that the embodiments of the invention are not limited to the foregoing adaptive signal processing, and a static weight or other algorithms may also be used in other embodiments. Moreover, in some embodiments, the processing device 50 may also not perform the foregoing interference elimination operation.

For signal division, the signal division module 52 may set a specific time length (such as 512, 1024, or 2048 sampling points), and divide the received signal RS (or the interference-eliminated output signal RS2) into a plurality of received signal groups RSG in a time domain based on the time length. That is, the sampling point number in each group is the same, and each group includes amplitudes corresponding to the plurality of sampling points. Similarly, the signal division module 52 also divides the transmitted signal TS into a plurality of transmitted signal groups TSG in the time domain based on the same time length. The signal division module 52 may implement signal division by using a window function (i.e., the window function is a constant in a given interval and 0 outside the interval).

Figure 4A:
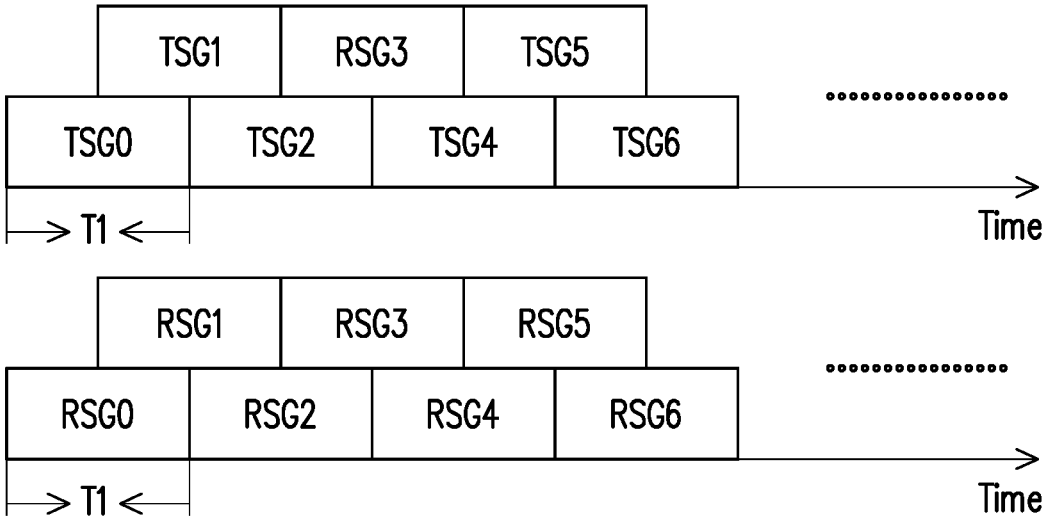
FIG. 4A and FIG. 4B are schematic diagrams of signal division according to one embodiment of the invention.
Figure 4B:
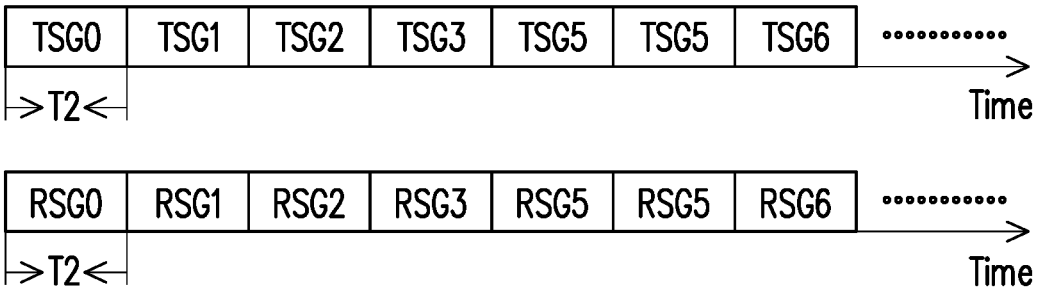

For example, FIG. 4A and FIG. 4B are schematic diagrams of signal division according to one embodiment of the invention. Referring to FIG. 4A at first, the signal division module 52 sets a time length T1 to include 256 sampling points hypothetically. 0 to 255 sampling points are corresponding to a transmitted signal group TSG0 and a received signal group RSG0. 128 to 383 sampling points are corresponding to a transmitted signal group TSG1 and a received signal group RSG1. 256 to 511 sampling points are corresponding to a transmitted signal group TSG2 and a received signal group RSG2. 384 to 639 sampling points are corresponding to a transmitted signal group TSG3 and a received signal group RSG3. 512 to 767 sampling points are corresponding to a transmitted signal group TSG4 and a received signal group RSG4. 640 to 895 sampling points are corresponding to a transmitted signal group TSG5 and a received signal group RSG5. 768 to 1023 sampling points are corresponding to a transmitted signal group TSG6 and a received signal group RSG6. The sampling points corresponding to different groups may be overlapped to improve a flow phenomenon.

Referring to FIG. 4B, the signal division module 52 sets a time length T2 to include 128 sampling points hypothetically. 0 to 127 sampling points are corresponding to the transmitted signal group TSG0 and the received signal group RSG0. 128 to 255 sampling points are corresponding to the transmitted signal group TSG1 and the received signal group RSG1. 256 to 383 sampling points are corresponding to the transmitted signal group TSG2 and the received signal group RSG2. 384 to 511 sampling points are corresponding to the transmitted signal group TSG3 and the received signal group RSG3. 512 to 639 sampling points are corresponding to the transmitted signal group TSG4 and the received signal group RSG4. 640 to 767 sampling points are corresponding to the transmitted signal group TSG5 and the received signal group RSG5. 768 to 1279 sampling points are corresponding to the transmitted signal group TSG6 and the received signal group RSG6. The sampling points corresponding to different groups are not repeated.

It should be noted that the ways to divide the received signal RS and the transmitted signal TS are not limited to those as shown in FIG. 4A and FIG. 4B, but the division forms of the two signals shall be consistent (i.e., the time lengths/sampling points for division are the same, and the division is performed once at an interval of equal sampling point number).

Next, the screening module 53 selects to-be-evaluated groups TG from the received groups according to a correlation between the transmitted signal groups TSG and the received signal groups RSG (Step S230). Specifically, in the prior art, energy of all the groups is averaged as final measured signal energy. However, the received signal may be unstable due to external interferences and may cause an extremely large difference between mean energy and actual energy.

In order to avoid the aforementioned problem, the screening module 53 may screen the received signal groups. In one embodiment, the screening module 53 classifies close correlations between the transmitted signal groups TSG and the received signal groups RSG to form a plurality of delay categories. The correlations referred to herein are corresponding to delays between the transmitted signal and the received signal. The screening module 53 may judge a similarity/correlation between each received signal group RSG and the corresponding transmitted signal group TSG (corresponding to the same sampling points) by using fast cross correlation or other cross correlation algorithms.

Figure 5:
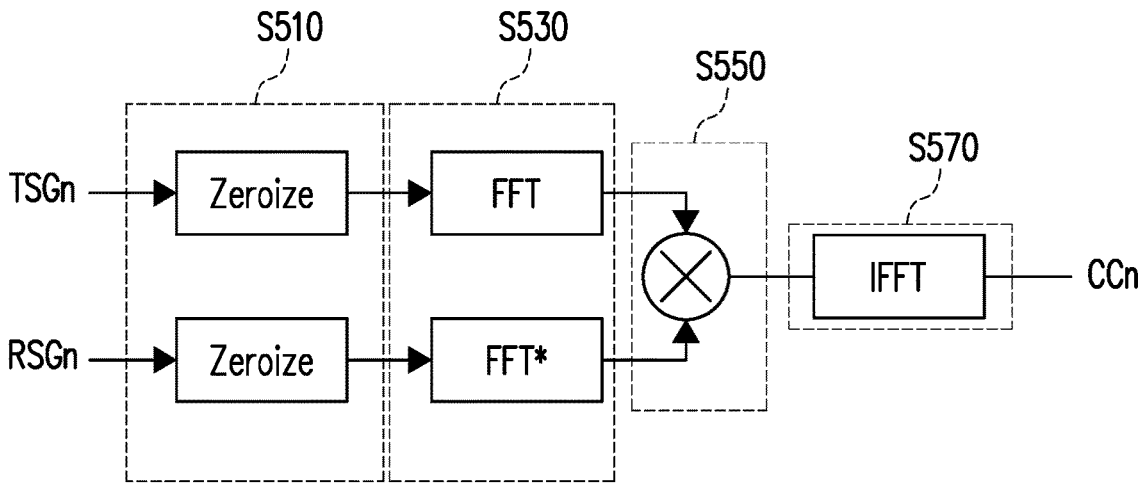
FIG. 5 is a schematic diagram of fast cross correlation determination according to one embodiment of the invention.

For example, FIG. 5 is a schematic diagram of fast cross correlation determination according to one embodiment of the invention. Referring to FIG. 5, assuming that the time length of the nth (n is a positive integer greater than zero) transmitted signal group TSGn and the nth received signal group RSGn includes 1024 sampling points, the screening module 53 respectively zeroizes the two groups TSGn and RSGn to 2048 sampling points (Step S510), then respectively performs Fourier transform and calculates a complex conjugate (Step S530, wherein a Fourier transform result of the received signal group RSGn may also be applied to a subsequent signal energy calculation step) after the Fourier transform, and the two results obtained in Step S530 are multiplied (Step S550), and inverse Fourier transform is performed on a product (Step S570) to obtain an nth correlation coefficient CCn (i.e., the foregoing correlation) among the plurality of sampling points in the two groups TSGn and RSGn.

Figure 6:
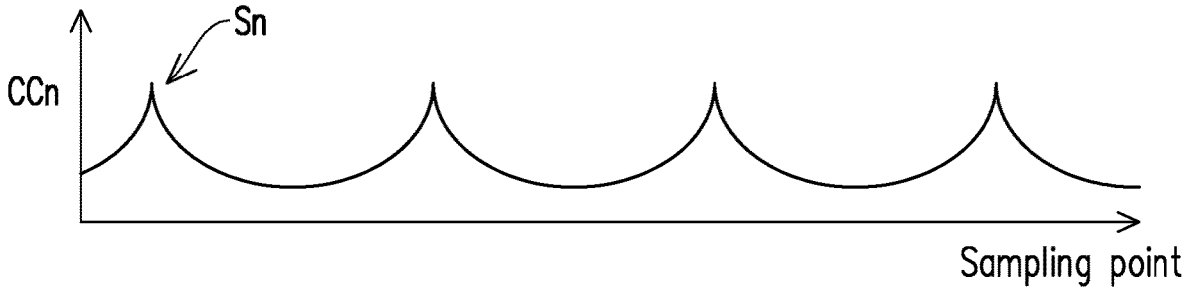
FIG. 6 is an example illustrating a reciprocal diagram of correlations and sampling points.

For example, FIG. 6 is an example illustrating a reciprocal diagram of correlations and sampling points. Referring to FIG. 6, since both the transmitted signal and the received signal have the periodic change characteristics, the correlation coefficient may also change periodically as sequence numbers of the sampling points increase, and the similarity between them may be corresponding to a phase/time delay.

In addition, since the correlation coefficient of each corresponding combination (i.e., one received signal group RSG and one corresponding transmitted signal group TSG) at different sampling points may be possibly different, the screening module 53 may select one correlation coefficient (or more correlation coefficients for arithmetic averaging or other formulas) as a representative of the correlation of each corresponding combination. In one embodiment, the screening module 53 uses the largest correlation (if there are still a plurality of largest correlations, the earliest one/the former one or one of them may be selected, and may be obtained through a peak-detect method) of the plurality of sampling points between each received signal group RSG and each corresponding transmitted signal group TSG as the representative of the correlation between the received signal group RSG and the corresponding transmitted signal group TSG. Taking FIG. 6 as an example, the correlation coefficient of the largest and earliest correlation corresponding to the sampling point Sn may be used as the representative that may be used for subsequent screening.

Next, the screening module 53 sorts the correlations corresponding to the different received signal groups RSG according to sizes, and classifies close correlations (for example, a difference between two correlations is less than a threshold) into the same delay categories by using a classification algorithm. For example, if the correlation coefficients are 10, 10, 10, 11, 12, 15 and 20, the screening module 53 classifies 10, 10, 10, 11 and 12 into a first delay category, classifies 15 into a second delay category, and classifies 20 into a third delay category.

The screening module 53 may select one of the delay categories as a to-be-evaluated category according to quantities of the coefficients in these delay categories. In one embodiment, the screening module 53 selects the delay category with a greatest number of coefficients as the to-be-evaluated category. Taking the foregoing three delay categories as an example, the first delay category including most corresponding correlation coefficients may be used as the to-be-evaluated category. In other embodiments, quantity-depending selection may vary depending on an actual requirement.

In one embodiment, the screening module 53 may further screen the to-be-evaluated category. The screening module 53 may classify close signal energy of the received signal groups RSG corresponding to the to-be-evaluated category to form a plurality of energy categories. The screening module 53 performs Fourier transform on the received signal groups RSG to transform the signals from the time domain to a frequency domain, and further calculates the signal energy (such as a sum of squared amplitude).

Next, the screening module 53 sorts the signal energy corresponding to the different received signal groups RSG according to sizes, and classifies close signal energy (for example, a difference between two signal energy is less than a threshold) into the same energy categories by using the classification algorithm. For example, if the signal energy is 1,000, 980, 1,500, 700 and 1,010, the screening module 53 classifies 1,000, 980 and 1,010 into a first energy category, classifies 1,500 into a second energy category, and classifies 700 into a third energy category.

The screening module 53 may select one of the energy categories as a new to-be-evaluated category according to quantities of the signal energy in the energy categories. In one embodiment, the screening module 53 selects the energy category with a greatest number of signal energy from the energy categories as the new to-be-evaluated category. Taking the foregoing three energy categories as an example, the first energy category including most signal energy may be used as the new to-be-evaluated category. In other embodiments, quantity-depending selection may vary depending on an actual requirement. In addition, the screening module 53 may also omit the screening for the signal energy, but directly uses a screening result of the delay categories as the to-be-evaluated category.

Next, the screening module 53 may determine to-be-evaluated groups TG according to the plurality of received signal groups RSG corresponding to the to-be-evaluated category. In one embodiment, the screening module 53 may select all or part of the received signal groups RSG corresponding to the to-be-evaluated category as the to-be-evaluated groups TG. For example, all the received signal groups RSG corresponding to the foregoing first energy category are used as the to-be-evaluated groups TG. The energy determining module 54 may determine the signal energy of the received signal according to the signal energy of the to-be-evaluated groups TG (Step S250). In one embodiment, the energy determining module 54 obtains an arithmetic mean of the signal energy of each to-be-evaluated group TG, and uses the arithmetic mean as the final measured signal energy of the center frequency (i.e., the signal energy of the received signal). In other embodiments, the energy determining module 54 may also obtain a median or mode from the signal energy of the to-be-evaluated groups TG as the final measured signal energy.

Based on the above, the correction system and the correction method of signal measurement of the embodiments of the invention perform extra signal processing, which may be divided into two independent portions, on the received signal. The first portion is to maintain the periodic change characteristic for this frequency in the received signal by using the adaptive signal processing, and the second portion is to screen all the groups based on a stable time migration characteristic and a stable energy state of the periodic signals. Therefore, the accuracy of signal measurement may be improved, and the dual-track balance effect may be less affected by interference.

Although the invention is described with reference to the above embodiments, the embodiments are not intended to limit the invention. A person of ordinary skill in the art may make variations and modifications without departing from the spirit and scope of the invention. Therefore, the protection scope of the invention should be subject to the appended claims.

What is claimed is:

1. A correction method of signal measurement, comprising:

dividing a transmitted signal and a received signal into a plurality of transmitted signal groups and a plurality of received signal groups according to a time length, respectively, wherein the received signal is related to a signal received after the transmitted signal is transmitted, and the transmitted signal is a periodic signal;

selecting a plurality of to-be-evaluated groups from the plurality of received signal groups according to a correlation between the plurality of transmitted signal groups and the plurality of received signal groups, wherein the correlation corresponds to a delay between the transmitted signal and the received signal, and the step of selecting the plurality of to-be-evaluated groups further comprises:

classifying close correlations between the plurality of transmitted signal groups and the plurality of received signal groups to form a plurality of delay categories;

selecting one to-be-evaluated category from the plurality of delay categories according to quantities of correlations in the plurality of delay categories; and determining the plurality of to-be-evaluated groups according to the plurality of received signal groups corresponding to the to-be-evaluated category; and determining signal energy of the received signal according to signal energy of the plurality of to-be-evaluated groups.

2. The correction method of signal measurement according to claim 1, wherein the step of selecting the to-be-evaluated category from the plurality of delay categories comprises:

selecting the one comprising a greatest number of correlations included in the plurality of delay categories as the to-be-evaluated category.

3. The correction method of signal measurement according to claim 1, wherein before forming the plurality of delay categories, the correction method further comprises:

using the largest one of the correlations of a plurality of sampling points between each received signal group and the corresponding transmitted signal group as a representative of the correlations between the received signal group and the corresponding transmitted signal group.

4. The correction method of signal measurement according to claim 1, wherein the step of determining the plurality of to-be-evaluated groups according to the received signal groups corresponding to the to-be-evaluated category comprises:

classifying close signal energy of the plurality of received signal groups corresponding to the to-be-evaluated category to form a plurality of energy categories; and selecting the one comprising a greatest number of signal energy from the plurality of energy as a new to-be-evaluated category.

5. The correction method of signal measurement according to claim 1, wherein before dividing the transmitted signal and the received signal into the plurality of transmitted signal groups and the plurality of received signal groups, the correction method further comprises:

playing the transmitted signal and receiving sounds to generate a sound received signal, wherein the periodic signal is a sinusoidal signal; and eliminating interference in the sound received signal according to a signal characteristic of the transmitted signal to obtain the received signal, wherein the signal characteristic is related to a periodic change of the periodic signal, and the received signal comprises the signal characteristic.

6. The correction method of signal measurement according to claim 1, wherein the step of selecting the plurality of to-be-evaluated groups from the plurality of received signal groups according to the correlation between the plurality of transmitted signal groups and the plurality of received signal groups comprises:

using fast cross correlation to determine the correlation between one of transmitted signal groups and a corresponding one of received signal groups.

7. The correction method of signal measurement according to claim 1, wherein at least one sampling points in one of the received signal groups is overlapped with at least one sampling points in another of the received signal group, or at least one sampling points in one of the received signal groups is overlapped with at least one sampling points in another of the transmitted signal groups is overlapped with at least one sampling points in another of the transmitted signal groups.

8. A correction system of signal measurement, comprising:

a processing device, loaded with and executing a plurality of modules, wherein the plurality of modules comprises:

a signal division module, configured to divide a transmitted signal and a received signal into a plurality of transmitted signal groups and a plurality of received signal groups according to a time length, respectively, wherein the received signal is related to a signal received after the transmitted signal is transmitted, and the transmitted signal is a periodic signal;

a screening module, configured to select a plurality of to-be-evaluated groups from the plurality of received signal groups according to a correlation between the plurality of transmitted signal groups and the plurality of received signal groups, wherein the correlation corresponds to a delay between the transmitted signal and the received signal, and the screening module classifies close correlations between the plurality of transmitted signal groups and the plurality of received signal groups to form a plurality of delay categories, selects one to-be-evaluated category from the plurality of delay categories according to quantities of correlations in the plurality of delay categories, and determines the plurality of to-be-evaluated groups according to the plurality of received signal groups corresponding to the to-be-evaluated category; and an energy determining module, configured to determine signal energy of the received signal according to signal energy of the plurality of to-be-evaluated groups.

9. The correction system of signal measurement according to claim 8, wherein the screening module selects the one comprising a greatest number of correlations included in the plurality of delay categories as the to-be-evaluated category.

10. The correction system of signal measurement according to claim 8, wherein the screening module selects the largest one of the correlations of a plurality of sampling points between each received signal group and the corresponding transmitted signal group as a representative of the correlations between the received signal group and the corresponding transmitted signal group.

11. The correction system of signal measurement according to claim 8, wherein the screening module classifies close signal energy of the plurality of received signal groups corresponding to the to-be-evaluated category to form a plurality of energy categories, and the screening module selects the one comprising a greatest number from the plurality of energy categories as a new to-be-evaluated category.

12. The correction system of signal measurement according to claim 8, further comprising:

a speaker device, configured to play the transmitted signal, wherein the periodic signal is a sinusoidal signal; and a sound receiving device, configured to receive sounds in response to playing of the transmitted signal to generate a sound received signal, wherein the modules further comprise:

an interference elimination module, configured to eliminate interference in the sound received signal according to a signal characteristic of the transmitted signal to obtain the received signal, wherein the signal characteristic is related to a periodic change of the periodic signal, and the received signal comprises the signal characteristic.

13. The correction system of signal measurement according to claim 8, wherein the screening module uses fast cross correlation to determine the correlation between one of transmitted signal groups and a corresponding one of received signal groups.

14. The correction system of signal measurement according to claim 8, wherein at least one sampling points in one of the received signal groups is overlapped with at least one sampling points in another of the received signal group, or at least one sampling points in one of the received signal groups is overlapped with at least one sampling points in another of the transmitted signal groups is overlapped with at least one sampling points in another of the transmitted signal groups.

* * * * *